US006805115B2

(12) United States Patent
Campbell et al.

(10) Patent No.: US 6,805,115 B2
(45) Date of Patent: Oct. 19, 2004

(54) CATALYTIC EMBERS FOR USE WITH A GAS FIRED LOG SET

(75) Inventors: Larry E. Campbell, Knoxville, TN (US); Tracy D. Staller, Knoxville, TN (US); Douglas Campbell, Knoxville, TN (US)

(73) Assignee: Advanced Catalyst Systems, LLC, Maryville, TN (US)

( * ) Notice: Subject to any disclaimer, the term of this patent is extended or adjusted under 35 U.S.C. 154(b) by 0 days.

(21) Appl. No.: 10/214,018

(22) Filed: Aug. 7, 2002

(65) Prior Publication Data

US 2003/0039932 A1 Feb. 27, 2003

Related U.S. Application Data

(60) Provisional application No. 60/311,204, filed on Aug. 9, 2001.

(51) Int. Cl.[7] ..... F24C 5/00

(52) U.S. Cl. ..... 126/512; 126/92 R; 431/125

(58) Field of Search ..... 126/512, 92 R, 126/92 AC, 503, 92 A; 431/125, 126, 347, 354, 326, 328, 329; 502/262

(56) References Cited

U.S. PATENT DOCUMENTS 3,867,311 A * 2/1975 Johnson ..... 502/262
3,925,001 A 12/1975 Salooia ..... 431/4
4,992,041 A * 2/1991 Kewish et al. ..... 431/126
5,000,162 A 3/1991 Shimek et al. ..... 126/512
5,052,370 A 10/1991 Karabin ..... 126/512
5,081,981 A * 1/1992 Beal ..... 126/92 R
5,429,495 A * 7/1995 Shimek et al. ..... 126/512
5,839,427 A 11/1998 Shorts ..... 126/512
5,988,159 A 11/1999 Blount ..... 126/512
6,006,742 A * 12/1999 Jamieson et al. ..... 126/512
6,095,794 A 8/2000 Jamieson et al. ..... 431/125
6,296,474 B1 10/2001 Butler et al. ..... 431/125

* cited by examiner

*Primary Examiner*—James C. Yeung
(74) *Attorney, Agent, or Firm*—Kenneth H. Johnson

(57) ABSTRACT

A synthetic ember comprising refractory ceramic wool coated with about 0.10 wt. % to about 5.0 wt. % of an oxidation catalyst of Pt, Pd, Rh, Co, Mn and mixtures thereof for use in small pieces as embers in a gas-fired log set or fireplace. The refractory ceramic wool preferably has a surface area of from 20 to 200 square meters per gram and a density of 0.01 to 0.05 grams per cubic centimeter and the catalytic embers are less than one inch square. The synthetic embers increase heat recoverable at a given BTU from a flame, with reduced nitrogen oxides, hydrocarbons and CO emissions and improved aesthetics.

16 Claims, 1 Drawing Sheet

CATALYTIC EMBERS FOR USE WITH A GAS FIRED LOG SET

This application claims the benefit of provisional application No. 60/311,204, filed Aug. 9, 2001.

BACKGROUND OF THE INVENTION

1. Field of the Invention

The present invention relates to the artificial logs used in a gas fireplace, and in particular to improved aesthetics, heat generation and combustion emissions.

2. Related Information

Gas log sets are made of ceramic or concrete logs and a burner assembly fueled by natural gas, propane and in some cases butane. These gaseous fuels typically burn with a blue flame. In order to market these log sets the manufacturers have attempted to make the logs look real and have tweaked the burner to produce a dancing and flickering flame with yellow tips.

The gas log sets are typically set up with a burner assembly buried in a media such as sand, vermiculite, glass shards or cinders. The premixed gas and air are percolated up through the media where it is ignited to produce flames which flicker about the ceramic logs which are formed and colored to resemble wooden logs. "Rock Wool" chunks are placed on the top of the media to simulate wood embers. The flames heat the edges of the "Rock Wool" making them red hot and glowing. These embers somewhat simulate wool embers but they can contribute to the formation of soot, especially if burning propane or butane, by providing a surface where the hydrocarbons can pyrolize. "Rock wool" (also called mineral wool, mineral cotton, silicate cotton, and slag wool) is known in the art as a substance outwardly resembling wood, having a mass of interlaced filaments, made by subjecting furnace slag and some minerals with a strong blast while molten.

The United States Occupation Safety and Health Administration recognizes three general groups of Synthetic Mineral Fibers. They are fiber glass (glasswool and glass filament), mineral wool (rockwool and slagwool) and refractory ceramic fibers (RCF). Fiber glass and mineral wool are generally made by blowing or drawing fibers from a molten mass. Refractory ceramic fibers are generally made by chemical reactions, precipitation or vapor phase deposition. Refractory ceramic fibers (RCF) can have a higher porosity and surface roughness than the other groups of fibers and can also have higher chemical purity. All these differences are beneficial for applying and presenting catalysts. Refractory ceramic wool is produced by making a low density pad or mat of randomly oriented ceramic fibers of relatively short length. The resultant mat resembles wool pieces. Of special importance is the fiber diameter. Fibers smaller than 3 microns are considered to be respirable and damaging to lungs. Refractory ceramic fibers can be produced larger than 3 microns.

It is an advantage of the present invention that the amount of radiant energy from a fireplace is increased. A further advantage is that the emissions of hydrocarbons, nitrogen oxides and carbon monoxide are reduced. It is an additional feature that the present invention improves the aesthetics of a gas flame.

SUMMARY OF THE INVENTION

Briefly, the present invention is a synthetic ember comprising refractory ceramic wool pieces coated with an oxidation catalyst for use as embers in a gas-fired log set or fireplace. The oxidation catalyst may be selected from the group consisting of Pt, Pd, Rh, Co, Mn and mixtures thereof, preferably in the amount about 0.10 wt. % to about 5.0 wt. %. More preferably the oxidation catalyst comprises Pt. Preferably the refractory ceramic wool is comprised of filaments and has a surface area of from 20 to 200 square meters per gram and a density of 0.01 to 0.05 grams per cubic centimeter. Preferably the catalytic embers are less than one inch square and preferably less than one-half square inches each. Preferably the refractory ceramic fibers have diameters 3 microns and larger.

DETAILED DESCRIPTION

We have found that catalytic imitation embers can be produced: which burn fuel cleanly with minimal pyrolysis, which burn brighter with flickering characteristics, which give a larger degree of radiant energy and which offer over all more efficient which give a larger degree of radiant energy and which offer over all more efficient heating.

These embers are produced using a low density, high surface area refractory ceramic wool coated with a small amount of highly dispersed platinum. The catalytic embers are formed from a pad of the refractory ceramic wool and are cut into cubes. The cubes are placed in the bottom of the fireplace over the burner assembly and media.

Figure 1:
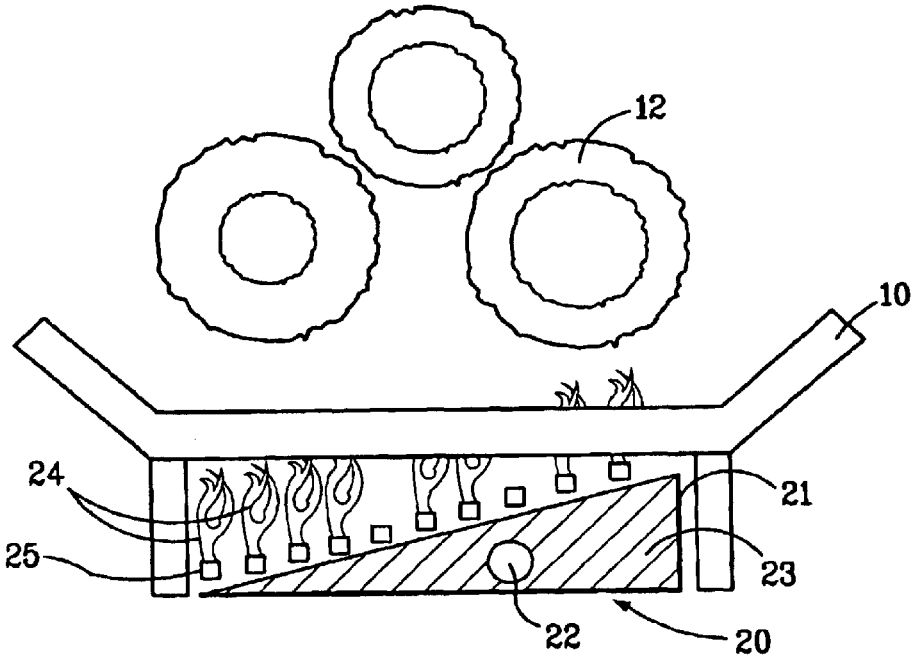
FIG. 1 is a schematic representation of the present synthetic embers position in relation to a percolation medium, gas flame and synthetic logs.

Referring to FIG. 1, a grate 10 having synthetic logs 12 positioned thereon above a gas burner 20, consisting of a pan 21, a gas delivery tube 22 and percolation media 23 producing flames 24. The simulated embers 25 consisting of refractory ceramic cubes of alumina fibers with platinum deposited thereon are positioned on top of the percolation media 23 where the gas partially combusts in the ember simulator providing a flickering glow more like that of a natural ember than the prior materials used in this manner.

Figure 2:
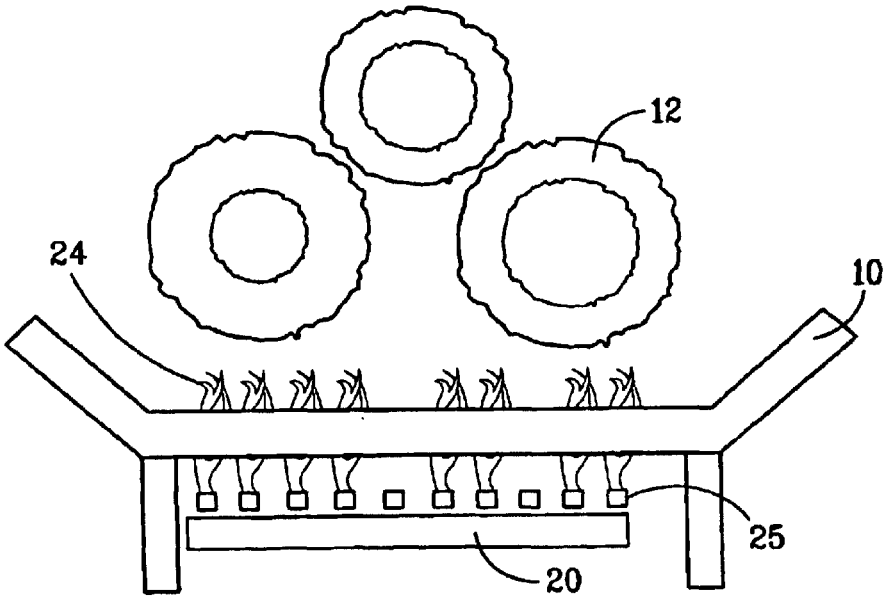
FIG. 2 is a schematic representation of an alternative means of positioning synthetic embers in relation to gas flame and synthetic logs.

Referring to FIG. 2, a grate 10 having synthetic logs 12 positioned thereon above a gas burner 20 consisting of a perforated metal or ceramic flow distributor which produces flames 24. The simulated embers 25 consisting of refractory ceramic cubes of alumina fibers with platinum deposited thereon are positioned on top of the burner 20 where the gas partially combusts in the ember simulator providing a flickering glow more like that of a natural ember than the prior materials used in this manner.

EXAMPLE 1

Saffil brand alumina silica fiber mat with a density of 0.026 grams per cubic centimeter and specific surface area of 160 square meters per gram was cut to a dimension of 12 inches square and 1.5 inches thick. This pad was immersed in a solution containing 0.07% by weight of platinum. The dry pad weighed 93.5 grams. After immersion the pad was squeezed to remove excess solution. The squeeze-dried pad weighed 724 grams. 630.5 grams of platinum solution containing 0.07 wt. % Pt was deposited on the fiber mat, which gave a pad containing 0.434 grams of Pt. The pad was dried overnight at room temperature and calcined in air at 500° C. for one hour. Based on a dry pad, the Pt content was 0.462 wt. %. The finished pad was divided to make two pads each about 0.75 inches thick. These pads were then cut into one inch by one half-inch pieces. These pieces were placed in the bottom of a CFM Majestic catalytic unvented natural gas fireplace. They were placed under the ceramic logs on top of the perforated ceramic burner plate. The front surface glass was installed and sealed. After the gas fireplace was ignited, the embers glowed bright red and flickered.

The glass temperature was measured at the bottom of the glass, in the middle and at the top. The same experiment was carried out for the fireplace without embers. The data is shown below:

| | With Embers | Without Embers |
|---|---|---|
| Bottom Temperature | 200° F. | 178° F. |
| Middle Temperature | 420° F. | 294° F. |
| Top Temperature | 400° F. | 347° F. |

These results show clearly that the embers generated more radiant energy, which heated the glass instead of the exhaust.

EXAMPLE 2

Saffil brand alumina silica fiber mat of alumina silica fibers, which have 3 to 6 micron diameter fibers and a specific surface area of 160 square meters per gram was cut to a dimension of 12 inches square and 1.5 inches thick. This pad was immersed in a solution containing 0.07% by weight of platinum. The dry pad weighed 93.5 grams. After immersion the pad weighed 1,538 grams. 1,444 grams of platinum solution containing 0.07 wt % Pt was deposited on the pad, which gave a pad containing 1.011 grams of Pt. Based on a dry pad the Pt content was 1.08 wt %.

The embers containing 1.08 wt % Pt were placed in the catalytic unvented fireplace as in Example 1. After ignition the embers glowed brighter and had a yellowish orange color. They also flickered.

EXAMPLE 3

The unvented catalytic fireplace as in Example 1 was loaded with "Rock Wool Embers" and the emissions were measured. In addition, catalytic embers (one square inch) were placed in the fireplace and the emissions were measured. The results corrected to a dry basis are shown below:

| | Rock Wool | Catalytic Embers |
|---|---|---|
| CO, ppm | 112 | 98 |
| Hydrocarbons, ppm | 150 | 130 |
| NOx, ppm | 11 | 9 |

The results show that "Rock Wool" embers gave higher emissions than the catalytic embers.

EXAMPLE 4

The same experiment as in Example 3 was performed except that the catalytic embers were cut in half. The results are shown below:

| | Catalytic Embers 1 Sq. Inch | Catalytic Embers 0.5 Sq. Inch |
|---|---|---|
| CO, ppm | 98 | 27 |
| Hydrocarbons, ppm | 130 | 48 |
| NOx, ppm | 9 | 9 |

These results show that smaller catalytic embers gave lower emissions.

EXAMPLE 5

Embers were prepared as in Example 2 except refractory ceramic wool with a density of 0.086 grams per cubic centimeter and specific surface area of about 1 square meter per gram was used. The platinum content was 0.5 wt %. The pad did not coat evenly and had a black surface and a white interior. When placed in the fireplace the embers glowed a dull red and only on the edges. This compared to embers on the high surface area low density Saffil brand material which was cherry red or yellow orange and glowed much more intensely.

EXAMPLE 6

Embers were prepared as in Example 2 except refractory ceramic wool with a density of 0.086 grams per cubic centimeter and specific surface area of about 1 square meter per gram was used. The platinum content was 0.5 wt %. The pad did not coat evenly and had a black surface and a white interior. When placed in the fireplace the embers glowed a dull red and only on the edges. This did not produce the desired aesthetic effect, compared with the preferred embers made of the high surface area low density Saffil brand material, which glowed cherry red or yellow orange and glowed much more intensely.

EXAMPLE 7

Rock wool which is normally used as simulated embers was coated with the platinum solution described in Example 2. Upon exposure the sample emitted a sulfurous odor. On drying and heating the embers, thus produced, did not produce the desired effect and became weak and crumbly.

The invention claimed is:

1. A synthetic ember for use in a gas fireplace comprising a refractory ceramic wool element having a surface area of from about 20 to about 200 square meters per gram and a density of about 0.01 to about 0.05 grams per cubic centimeter and coated with an oxidation catalyst.

2. The synthetic ember according to claim 1 wherein the oxidation catalyst is selected from the group consisting of Pt, Pd, Rh, Co, Mn and mixtures thereof.

3. The synthetic ember according to claim 2 wherein the oxidation catalyst is present in the amount in the range of about 0.10 wt. % to about 5.0 wt %.

4. The synthetic ember according to claim 3 wherein the ember is less than one inch square and preferably less than one-half square inches each.

5. The method of combustion comprising burning a hydrocarbon containing gas in proximity to a plurality of synthetic embers according to claim 1.

6. A method of combustion comprising burning a hydrocarbon containing gas in proximity to a plurality of synthetic embers according to claim 5 wherein the oxidation catalyst is selected from the group consisting of Pt, Pd, Rh, Co, Mn and mixtures thereof.

7. The method of combustion comprising burning a hydrocarbon containing gas in proximity to a plurality of synthetic embers according to claim 6 wherein the oxidation catalyst is present in an amount in the range of about 0.10 wt. % to about 5.0 wt. %.

8. A method of combustion according to claim 5 wherein the oxidation catalyst comprises Pt.

9. In combination in a combustion chamber comprising a burner, a support positioned above said burner and a plurality of synthetic embers according to claim 1 arrayed over said support.

10. A combination according to claim 9 wherein the oxidation catalyst is selected from the group consisting of Pt, Pd, Rh, Co, Mn and mixtures thereof.

11. A combination according to claim 10 wherein the oxidation catalyst is present in an amount in the range of about 0.10 wt. % to about 5.0 wt. %.

12. A combination according to claim 11 wherein the embers are less than one inch square and preferably less than one-half square inches each.

13. A combination according to claim 9 wherein the oxidation catalyst comprises Pt.

14. A method of combustion according to claim 5 wherein the refractory ceramic wool elements comprise filaments having diameters 3 microns and larger.

15. A synthetic ember according to claim 1 wherein the oxidation catalyst comprises Pt.

16. A synthetic ember according to claim 1 wherein the refractory ceramic wool elements comprise filaments having diameters 3 microns and larger.

* * * * *